US012279681B2

(12) United States Patent
Ma et al.

(10) Patent No.: US 12,279,681 B2
(45) Date of Patent: Apr. 22, 2025

(54) WRITING DEVICE PACKAGING BOXES

(71) Applicant: Hewlett-Packard Development Company, L.P., Spring, TX (US)

(72) Inventors: Xiang Ma, Spring, TX (US); Wei Hung Lin, Taipei (TW); Simon Wong, Spring, TX (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 18/560,549

(22) PCT Filed: Jun. 30, 2021

(86) PCT No.: PCT/US2021/039892
§ 371 (c)(1),
(2) Date: Nov. 13, 2023

(87) PCT Pub. No.: WO2023/277909
PCT Pub. Date: Jan. 5, 2023

(65) Prior Publication Data

US 2024/0245178 A1 Jul. 25, 2024

(51) Int. Cl.
*A45C 11/34* (2006.01)

(52) U.S. Cl.
CPC ..... *A45C 11/34* (2013.01); *A45C 2200/15* (2013.01)

(58) Field of Classification Search
CPC ..... A45C 11/34; A45C 2200/15
USPC ..... 206/224, 371
See application file for complete search history.

(56) References Cited

U.S. PATENT DOCUMENTS

| | | | | |
|---|---|---|---|---|
| 1,281,747 | A | 3/1918 | Allen et al. | |
| 2,804,198 | A * | 8/1957 | Rekonty | B43L 23/08 206/371 |
| 2,857,881 | A * | 10/1958 | Beebe | B65D 5/5014 30/454 |
| 4,111,299 | A | 9/1978 | Taub | |
| 5,188,227 | A * | 2/1993 | Ho | A45C 11/34 206/214 |
| 5,509,527 | A | 4/1996 | Wang | |
| 6,021,891 | A * | 2/2000 | Anderson | A45C 11/34 206/214 |
| 6,026,960 | A * | 2/2000 | Cogliano | A63H 3/005 206/457 |
| 6,105,759 | A | 8/2000 | Fuchs et al. | |

(Continued)

FOREIGN PATENT DOCUMENTS

| | | | |
|---|---|---|---|
| CN | 109515927 | A | 3/2019 |
| EP | 0462332 | A1 | 12/1991 |

(Continued)

*Primary Examiner* — Jacob K Ackun
(74) *Attorney, Agent, or Firm* — Knobbe, Martens, Olson & Bear, LLP

(57) ABSTRACT

An example of the present disclosure includes a packaging box, comprising a first section including a first aperture to receive a portion of a writing device, and a second section including a second aperture to receive a remainder of the writing device. The packaging box further includes a hinge mechanism coupling the first section to the second section, wherein the first section and second section are rotatable about the hinge mechanism. The packaging box also includes a tip remover including a surface to remove a tip of the writing device responsive to application of a force.

12 Claims, 6 Drawing Sheets

(56) References Cited

U.S. PATENT DOCUMENTS

| | | | | |
|---|---|---|---|---|
| 6,382,421 | B1 * | 5/2002 | Dao | B44D 3/04 206/371 |
| 6,887,006 | B1 * | 5/2005 | Carpenter | B43K 23/008 30/453 |
| 8,590,773 | B2 | 11/2013 | Moreau et al. | |
| 9,187,204 | B2 | 11/2015 | Mathieu et al. | |
| 9,617,030 | B2 | 4/2017 | Guardiola | |
| 11,937,675 | B1 * | 3/2024 | Khandelwal | B43K 29/00 |
| 2008/0190788 | A1 * | 8/2008 | Cziraky | B43M 99/00 206/214 |
| 2019/0246759 | A1 * | 8/2019 | Pineiro | B43K 31/00 |
| 2020/0187616 | A1 * | 6/2020 | Song | A45C 11/04 |
| 2022/0133033 | A1 * | 5/2022 | Bressingham | F16M 11/2092 108/25 |

FOREIGN PATENT DOCUMENTS

| | | | |
|---|---|---|---|
| FR | 2857335 | A1 | 1/2005 |
| GB | 1342597 | A | 1/1974 |

* cited by examiner

WRITING DEVICE PACKAGING BOXES

BACKGROUND

Boxes or cartons have been designed to facilitate the distribution of individual products or items contained within the box. Boxes with a dispenser have more than one kind of dispensing openings. Some boxes for packaging goods such as cans or bottles of soft drinks may enable consumers to transport and store such products. In the field of packaging, customers may be provided with a package comprising a plurality of containers of primary products. Such multi-packs may be used for shipping and distribution and for displaying promotional information. Reusable boxes may be used to store products that can be subtracted over time, in which a user may repeatedly open and close the box again.

A feature of repeated closure on a box allows a consumer to repeatedly open and close the box during use without using secondary devices, such as clips. One type of multi-lock feature for cardboard boxes, boxes, or envelope-type containers is a tongue and groove type closure. In such configurations, the container is closed by inserting the tongue into the groove. This type of closure can be found, for example, in cardboard boxes or containers, such as cereal boxes and chewing gum boxes.

DETAILED DESCRIPTION

Figure 1A:
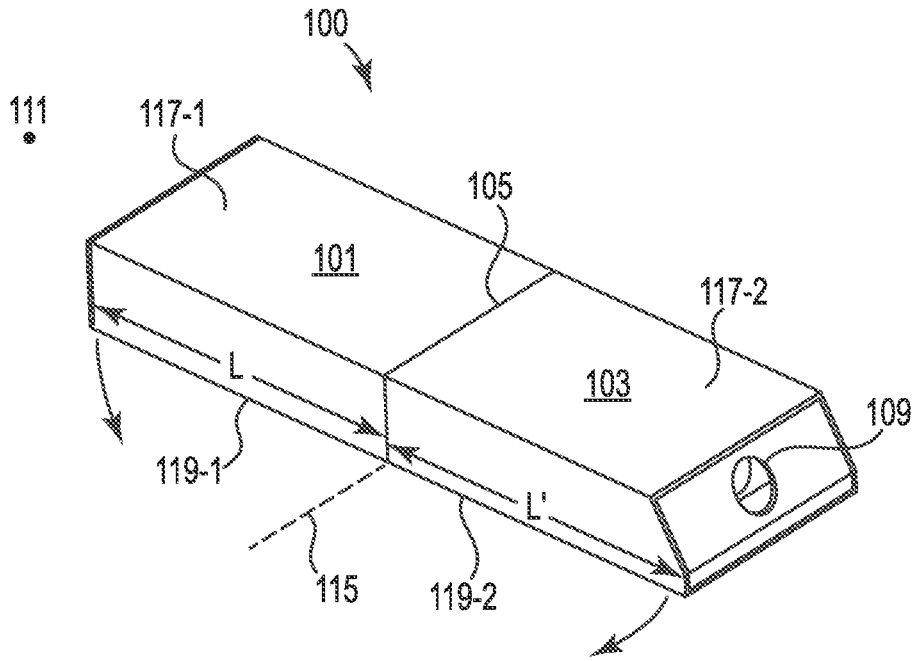
FIG. 1A illustrates an example writing device packaging box arranged in an unfolded configuration, in accordance with the present disclosure.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

There are many configurations for containers used in shipping. Some configurations of boxes include usage of portions of an adhesive tape to bond portions of the box together. The portions of the adhesive tape are used for assembly and closure of the box. For example, a box can include two flaps that are folded over an opening therein to facilitate closure of the box, and the portions of the adhesive tape can be used to join the two flaps of the box together to seal contents within the box. However, besides being an additional cost, adhesive tape may not be readily available for assembly and closure of the boxes, and may be restricted from being used to seal boxes during transit.

Often, packaging boxes are used to ship and/or transport an object. In such instances, the packaging box serves the purpose of transporting the object and then is discarded. With an increased interest in reducing environmental waste, manufacturers and consumers have placed greater emphasis on reducing waste, reusing objects, and recycling materials when possible. The most effective way to reduce waste is to not create it in the first place. Making a new product uses a lot of materials and energy—raw materials are extracted from the earth, and the product is fabricated then transported to wherever it will be sold. As a result, reduction and reuse are the most effective ways to save natural resources, protect the environment and save money. Reuse is the action or practice of using an item, whether for its original purpose or to fulfil a different function.

Some writing devices are transported to consumers in boxes. As used herein, a writing device refers to or includes a tool used to make legible markings, either in physical and/or digital form, on a media. Non-limiting examples of writing devices include pencils, markers, and pens, among others. Additional examples of writing devices include a stylus or other tool used to make legible markings on a digital surface and/or to otherwise interact with a digital surface. For instance, a writing device may include a passive pen, also referred to as a passive stylus, which includes a large tip made of rubber or conductive foam in order to emulate a user's finger. Another example of a writing device may include an active pen, also referred to as an active stylus, which includes electronic components and allows users to write directly onto the display of a computing device such as a smartphone, tablet computer or Ultrabook. An active pen may include electronic components which generate wireless signals that are picked up by a proprietary digitizer and transmitted to a dedicated controller, providing data on pen location, pressure and other functionalities. Additional features enabled by the active pen's electronics include palm rejection to prevent unintended touch inputs, and hover, which allows the computer to track the pen's location when it is held near, but not touching the screen. Most active pens feature one or more function buttons (e.g. eraser and right-click) that can be used in the place of a mouse or keyboard.

After being transported to a user, writing devices are often stored in or on a desk for easy access by users. Moreover, some writing devices include tips and/or components that can be removed and/or replaced. Such removable and/or replaceable components may be misplaced and/or may necessitate the use of specialized tools.

Writing device packaging boxes, in accordance with examples of the present disclosure, provide for a reusable packaging box that reduces waste and provides a storage location for writing devices. Instead of creating additional waste, writing device packaging boxes described herein may repurpose the packaging boxes, and provide a storage location for the writing device which reduces clutter and loss of writing device accessories. Moreover, aspects of the writing device packaging boxes, as described herein, may allow for the replacement and capture of writing device tips, while also accommodating cable charging as appropriate.

An example of writing device packaging boxes in accordance with the present disclosure includes a packaging box, comprising a first section including a first aperture to receive a portion of a writing device, and a second section including a second aperture to receive a remainder of the writing device. The packaging box further includes a hinge mechanism coupling the first section to the second section, wherein the first section and second section are rotatable about the hinge mechanism. The packaging box also includes a tip remover including a surface to remove a tip of the writing device responsive to application of a force.

Another example of writing device packaging boxes in accordance with the present disclosure includes a packaging box, comprising a body defining a cavity, wherein the body includes a first section and a second section, wherein the first section includes a first aperture to receive a portion of a writing device, and wherein the second section includes a second aperture to receive a remainder of the writing device. The packaging box also includes a hinge mechanism coupling the first section to the second section, wherein the first section and second section are rotatable about the hinge mechanism, and a base holder stored in the cavity, wherein the base holder is to retain the first section and the second section when the body is in a folded configuration.

Additional examples of the present disclosure describe a method of using writing device packaging boxes. An example method includes removing a base holder from a body of a packaging box, wherein the body defines a cavity that includes a first section and a second section, and wherein the first section includes a first aperture to receive a portion of a writing device and the second section includes a second aperture to receive a remainder of the writing device. The method further includes applying a force to the first section and to the second section, causing the first section and the second section to fold about a hinge mechanism of the packaging box, and inserting the body in a folded configuration into the base holder.

Turning now to the Figures, FIG. 1A illustrates an example writing device packaging box 100 arranged in an unfolded configuration, in accordance with the present disclosure. In various examples, the writing device packaging box 100 includes a first section 101 including a first aperture to receive a portion of a writing device, and a second section 103 including a second aperture 109 to receive a remainder of the writing device. As used herein, a writing device packaging box refers to or includes a packaging box including structural components to store a writing device. As described more thoroughly herein, the writing device packaging box may include multiple configurations. For instance, the writing device packaging box may be arranged in an unfolded configuration as illustrated in FIG. 1A. As used herein, an unfolded configuration of the writing device packaging box 100 refers to or includes an arrangement of the first section 101 and the second section 103, as illustrated in FIG. 1A, in which the first section 101 and the second section 103 are arranged serially. Also, the writing device packaging box may be arranged in a folded configuration. As used herein, a folded configuration of the writing device packaging box 100 refers to or includes an arrangement of the first section 101 and the second section 103, in which the first section 101 and the second section 103 are arranged in parallel.

As illustrated in FIG. 1A, the writing device packaging box 100 includes a first section 101 and a second section 103. It is noted that the designation of "first" and "second" do not delineate an order, but are used to distinguish one item and a second item of a same type. In the example illustrated in FIG. 1A, the first section 101 comprises a sub-part of the writing device packaging box 100, and the second section 103 comprises a sub-part of the writing device packaging box 100. The first section 101 may have a length L that is the same as and/or similar to a length L' of the second section 103, although examples are not so limited. For instance, the first section 101 may have a length L that is different than a length L' of the second section 103.

As illustrated in FIG. 1A, the writing device packaging box 100 includes an aperture to receive a writing device. In the example illustrated, a second aperture 109 in the second section 103 is partially illustrated as an opening and/or orifice to receive the writing device. As illustrated more thoroughly in FIG. 2, the second aperture 109 extends the length L' of the second section 103, and a first aperture (not expressly illustrated in FIG. 1A) may extend a portion of length L of the first section 101 or an entirety of first section 101. The first aperture of first section 101 and the entirety of the second aperture 109 of second section 103 are illustrated fully in FIG. 2.

The packaging box 100 further includes a hinge mechanism 105 coupling the first section 101 to the second section 103, wherein the first section 101 and second section 103 are rotatable about the hinge mechanism 105. As used herein, a hinge mechanism refers to or includes a connection between the first section 101 and the second section 103, allowing each to rotate. The first section 101 and the second section 103 may rotate relative to each other about a fixed axis of rotation 115. The hinge mechanism 105 may be made of flexible material or of moving components, among others.

In some examples, the first section 101 includes a first face wall 117-1 and a first back wall 119-1, and the second section 103 includes a second face wall 117-2 and a second back wall 119-2, wherein the first back wall 119-1 and the second back wall 119-2 comprise a contiguous surface with a lateral perforated line forming the hinge mechanism 105. For instance, the packaging box 100 may be comprised of cardboard, paper, plastic, composite, or other suitable packaging material, and first back wall 119-1 extending the length L of first section 101 may comprise a same piece of cardboard, paper, plastic, composite, or other suitable packaging material as second back wall 119-2. A perforated line or other flexible portion of the cardboard, paper, plastic, composite, or other suitable packaging material may form the hinge mechanism 105, although examples are not so limited. For instance, in some examples the hinge mechanism 105 may include a plurality or rotating components that couple the first section 101 and the second section 103.

Figure 1B:
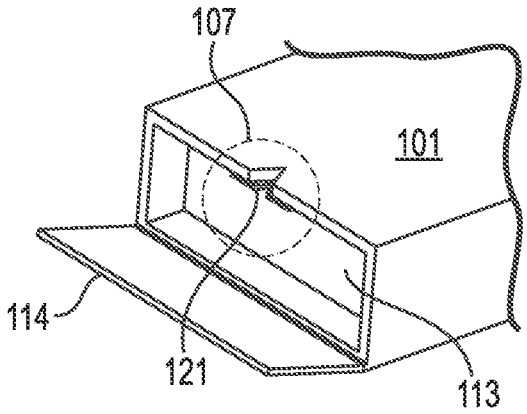
FIG. 1B illustrates a portion of the first section of the example writing device packaging box illustrated in FIG. 1A, in accordance with the present disclosure.

FIG. 1B illustrates a portion of the first section 101 of the example writing device packaging box 100 illustrated in FIG. 1A, in accordance with the present disclosure. The portion of the first section 101 illustrated in FIG. 1B from point 111 illustrated in FIG. 1A. As illustrated in FIG. 1B, in some examples of the packaging box 100, the first section 101 includes an orthogonal wall 113 defining a first storage area distal to the hinge mechanism 105. The first storage area may be enclosed by a first lid 114 capable of covering the opening formed by the orthogonal wall 113. Although not illustrated in FIG. 1B, the second section 103 may include an orthogonal wall defining a second storage area distal to the hinge mechanism. The second storage area of the second section 103 is illustrated in FIG. 2. As used herein a storage area refers to or includes a bottom (illustrated as "orthogonal wall 113") and at least two side walls extending outwardly from the bottom, within which on object or a plurality of objects may be stored.

In some examples, the packaging box 100 also includes a tip remover 107 including a surface to remove a tip of the writing device responsive to application of a force. For instance, referring to FIG. 1B, the tip remover 107 includes an aperture in the first face wall 117-1 and a reinforcement 121 coupled to the aperture, wherein the aperture in the face wall 117-1 and the reinforcement 121 having a concave surface to receive the tip of the writing device and apply a resistive force in response to removal of the writing device from the aperture. In some examples, the reinforcement 121 comprises a reinforcing metal plate, although examples are not so limited and the reinforcement 121 may be comprised of any material that provides additional tensile strength to the tip remover 107.

FIGS. 2A, 2B, 2C, and 2D illustrate various portions of an example writing device packaging box 200 arranged in an unfolded configuration and including internal apertures, in accordance with the present disclosure. The packaging box 200 has been divided into separate portions for illustration and discussion, with all portions illustrated in FIG. 2D. The packaging box 200 may be the same as or similar to the packaging box 100 illustrated in FIG. 1A and FIG. 1B, and similar elements are numbered accordingly. For instance, first section 201 is the same as or similar to first section 101, second section 203 is the same as or similar to second section 103, hinge mechanism 205 is the same as or similar to hinge mechanism 105, and axis of rotation 215 is the same as or similar to the axis of rotation 115.

Figure 2A:
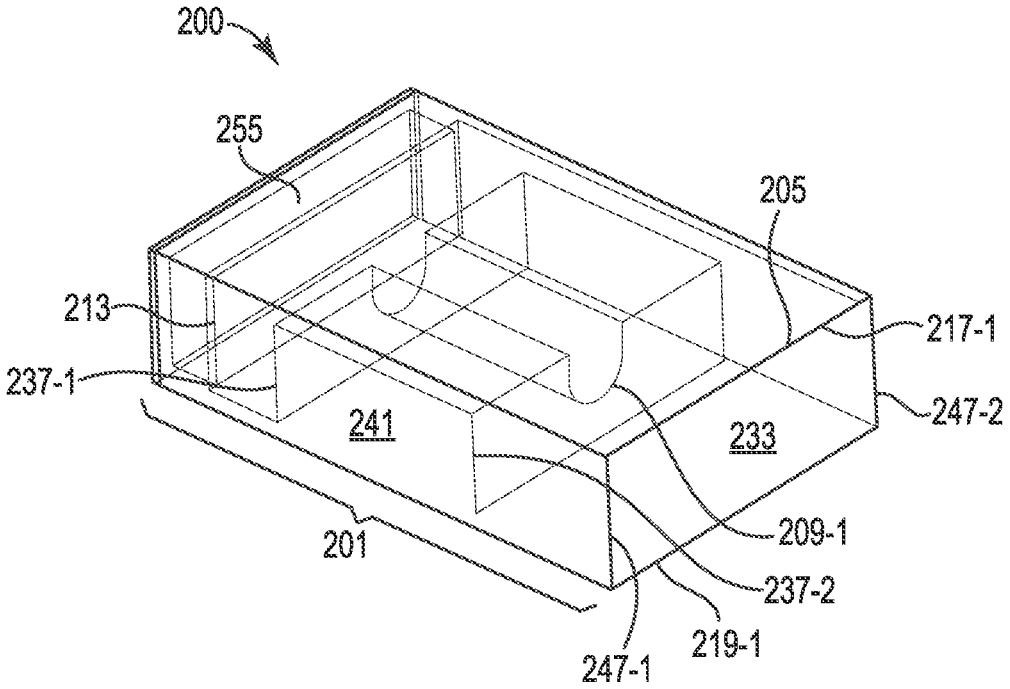
FIGS. 2A, 2B, 2C, and 2D illustrate various portions of an example writing device packaging box arranged in an unfolded configuration and including internal apertures, in accordance with the present disclosure.
Figure 2B:
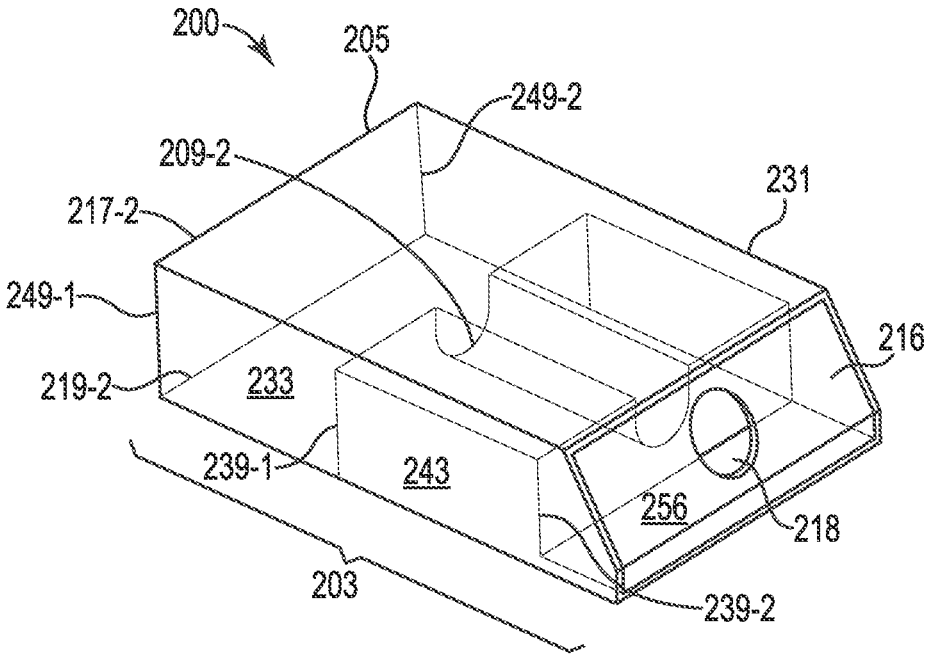
Figure 2C:
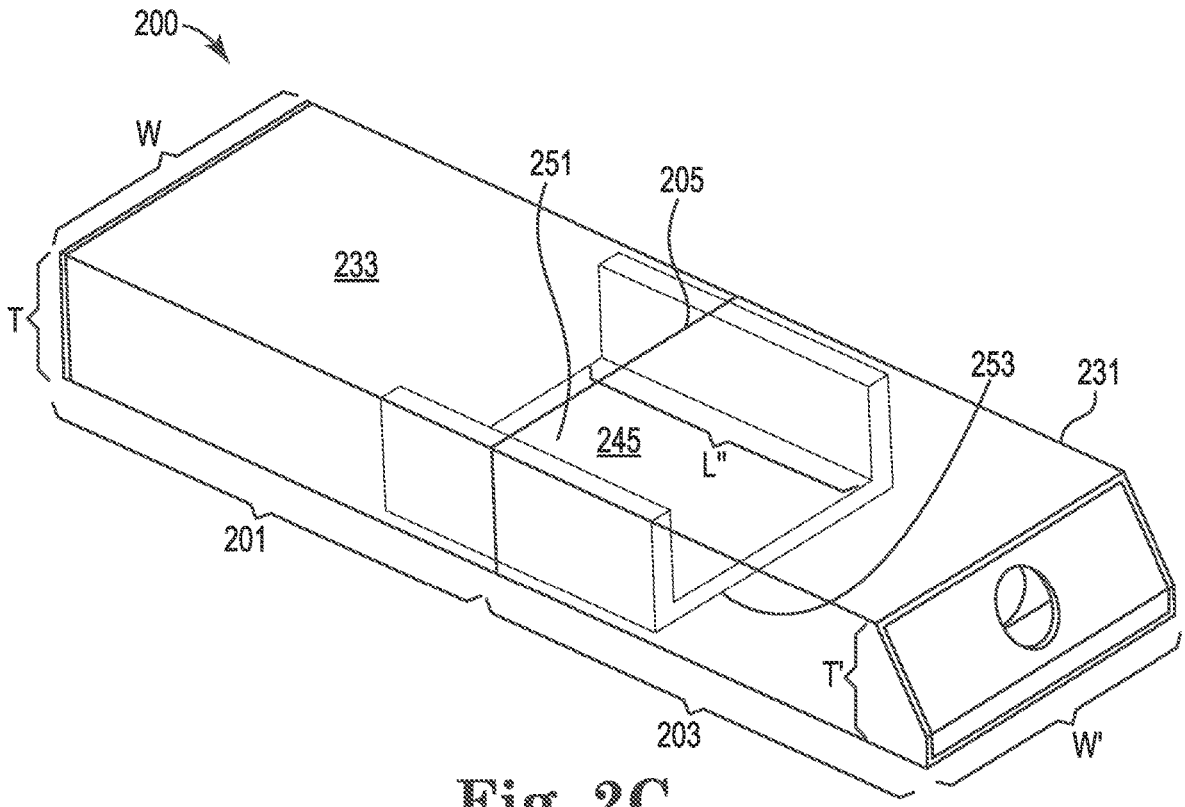
Figure 2D:
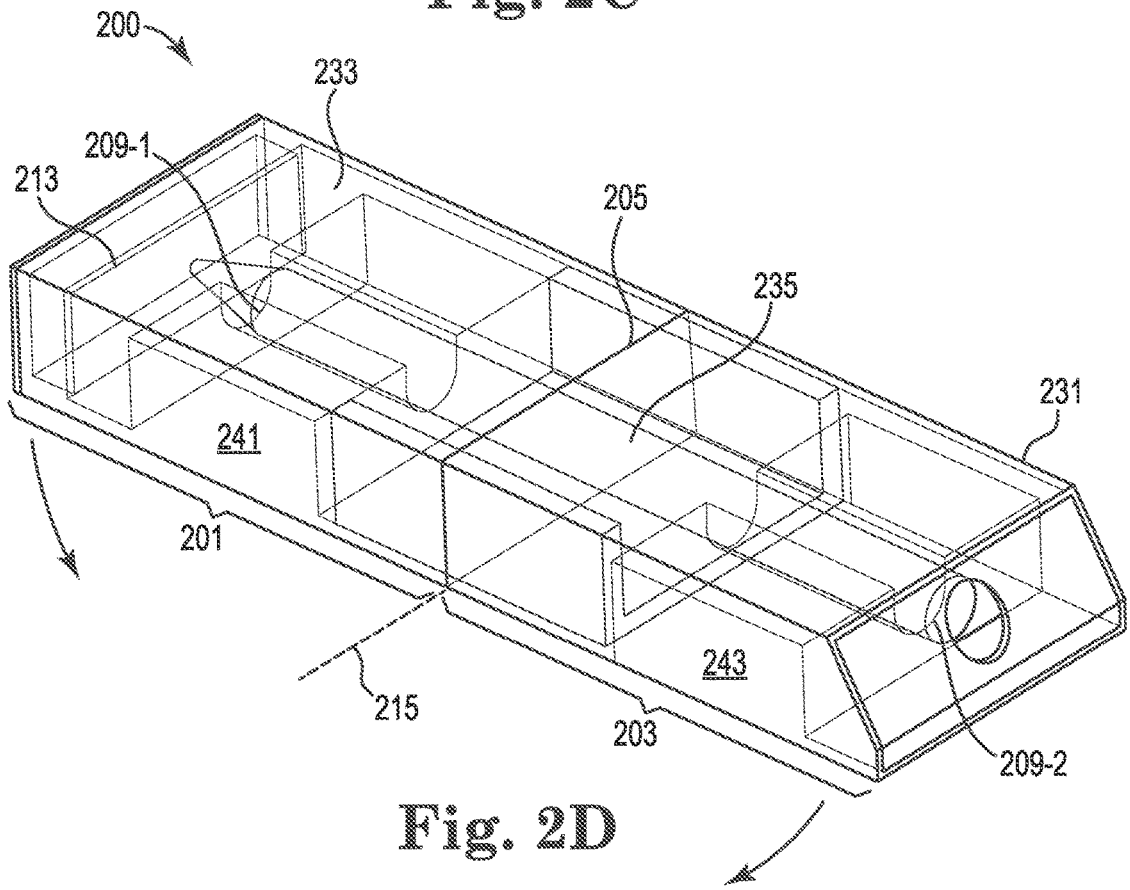

FIG. 2A illustrates a cut-out of an example packaging box 200 cut along a hinge mechanism 205 and including the first section 201, in accordance with the present disclosure. FIG. 2B illustrates a cut-out of the example packaging box 200 cut along the hinge mechanism 205 and including the second section 203, in accordance with the present disclosure. FIG. 2C illustrates the example packaging box 200 including the first section 201, the second section 203, and a base holder 245, in accordance with the present disclosure. FIG. 2D illustrates the example packaging box 200 including the first section 201, the second section 203, a base holder 245, a supportive section 241 of the first section 201 and a supportive section 243 of the second section 203, in accordance with the present disclosure.

In various examples, the packaging box 200 may include a body defining a cavity. As used herein, the body 231 of the packaging box 200 refers to or includes a plurality of walls of a solid material, arranged to define the various portions of the packaging box 200 described herein. The cavity 233, as used herein, refers to or includes a space between the walls of solid material comprising the body 231 and including an internal space within the body 231. Referring to FIG. 2A, the cavity 233 is formed by a first face wall 217-1, a first back wall 219-1 parallel to the face wall 217-1, a first side wall 247-1 and a second side wall 247-2 parallel to the first side wall 247-1. As illustrated, the first side wall 247-1 of the first section 201, and the second side wall 247-2 of the first section 201 are generally orthogonal to the first face wall 217-1 and the first back wall 219-1. In some examples, the first section 201 includes a first storage area 255 that is distal to the hinge mechanism 205. In such examples, the first storage area 255 may include a tip remover, as discussed with regards to FIG. 1A and FIG. 1B. The first storage area 255 may be defined by an orthogonal wall 213 distal to the hinge mechanism 205.

Referring to FIG. 2B, the cavity 233 is formed by a second face wall 217-2, a second back wall 219-2 parallel to the face wall 217-2, a first side wall 249-1 and a second side wall 249-2 parallel to the first side wall 249-1. As illustrated, the first side wall 249-1 of the second section 203, and the second side wall 249-2 of the second section 203 are generally orthogonal to the second face wall 217-2 and the second back wall 219-2.

In various examples, the body 231 includes a first section 201 a second section 203, wherein the first section 201 includes a first aperture 209-1 to receive a portion of a writing device, and wherein the second section 203 includes a second aperture 209-2 to receive a remainder of the writing device. For the ease of review, the writing device is not illustrated in FIG. 2A and FIG. 2B, but is illustrated in FIG. 2D.

In some examples, the first aperture 209-1 of the first section 201 is defined by a first plurality of side walls extending parallel to the hinge mechanism 205, and the second aperture 209-2 of the second section 203 is defined by a second plurality of side walls extending parallel to the hinge mechanism 205. For instance, referring to FIG. 2A, the first section 201 may include a supportive section 241 disposed between side walls 237-1 and 237-2 of the first section 201. As illustrated, the supportive section 241 of the first section 201 may include a recessed surface that is concave shaped so as to receive the writing device 235, wherein the concave shaped surface comprises the first aperture 209-1.

Similarly, referring to FIG. 2B, the second section 203 may include a supportive section 243 disposed between side walls 239-1 and 239-2 of the second section 203. The supportive section 243 of the second section 203 may include a recessed surface that is concave shaped so as to receive the writing device, wherein the concave shaped surface comprises the second aperture 209-2. Although the first aperture 209-1 and the second aperture 209-2 are described herein as having a concave shape, examples are not so limited. The first aperture 209-1 and the second aperture 209-2 may be square, rectangular, triangular, or any other shape to receive the writing device 235.

As described herein, the packaging box 200 may also include a hinge mechanism coupling the first section to the second section, wherein the first section and second section are rotatable about the hinge mechanism. For instance, referring to FIG. 2C and FIG. 2D, the hinge mechanism 205 may couple the first section 201 and the second section 203. The first section 201 and the second section 203 may rotate about axis of rotation 215 in the direction of the downward pointing arrows illustrated in FIG. 2D.

In various examples, the packaging box 200 also includes a base holder stored in the cavity, wherein the base holder is to retain the first section and the second section when the body is in a folded configuration. As used herein, a base holder refers to or includes a structure including a base and orthogonal side walls configured to receive and support the packaging box 200. In an unfolded configuration, such as the configuration illustrated in FIG. 1A, FIG. 20, and FIG. 2D, the base holder 245 may be disposed between the first section 201 and the second section 203 and may assist with coupling the first section 201 and the second section 203. For instance, referring to FIG. 2C, the base holder 245 may be stored in the cavity 233 formed by body 231. As illustrated and discussed further herein, the base holder 345 may retain the first section 201 and the second section 203 when the body 231 is in a folded configuration.

In some examples, the base holder 245 has a width W" approximately equal to a width W of the first section 201 and a width W' of the second section 203. In some examples, the width W" of the base holder 245 is less than the width W of the first section 201 and the width W' of the second section 203 such that the base holder 245 can fit inside the cavity 233 of the body 231. In some examples, the base holder 245 has a length L" approximately equal to a sum of a thickness T of the first section 201 and a thickness T' of the second section 203. In some examples, the base holder 245 includes a top surface 251 to receive the first section 201 and the second section 203 when the packaging box 200 is folded at the hinge mechanism 205, and a bottom surface 253 opposite of the top surface 251. In some examples, the top surface 251 includes a protective substrate to receive a tip of the writing device. For instance, the top surface 251 may include a plastic, rubber, and/or flexible surface that may receive a tip of the writing device (e.g., 235 illustrated in FIG. 2D) when in a folded configuration.

As discussed with regards to FIG. 1A and FIG. 1B, in some examples, the first section 201 includes a first face wall 217-1 and a first back wall 219-1, and the second section 203 includes a second face wall 217-2 and a second back wall 219-2, wherein the first back wall 219-1 and the second back wall 219-2 include fastening means to couple the first section 201 and the second section 203. Although not illustrated herein, in some examples, a removable flap may be coupled to the first section 201 or the second section 203. The removable flap may hold a tip of the writing device away from the base holder.

In some examples, the packaging box 200 may include a second lid 216 disposed at an end of the second section 203 distal to the hinge mechanism 205. The second lid 216 may similarly have an aperture 218. The aperture 218 of the second lid 216 may allow for cable charging of the writing device when stored in the packaging box 200. The side wall 239-2 and the second lid 216 may form a second storage area 256 of the second section 203, wherein the second storage area 256 is distal to the hinge mechanism 205. The second lid 216 may open and close, and provide access to the writing device 235.

FIGS. 3A, 3B, 3C, and 3D illustrate an example block diagram of a method for transforming a writing device packaging box from an unfolded configuration to a folded configuration, in accordance with the present disclosure. The packaging box 300 may be the same as or similar to the packaging box 200 illustrated in FIGS. 2A, 2B, 2C, and 2D, and packaging box 100 illustrated in FIG. 1A and FIG. 1B 100, and similar elements are numbered accordingly. For instance, first section 301 is the same as or similar to first section 101, second section 303 is the same as or similar to second section 103, hinge mechanism 305 is the same as or similar to hinge mechanism 105, and axis of rotation 315 is the same as or similar to the axis of rotation 115.

Figure 3C:
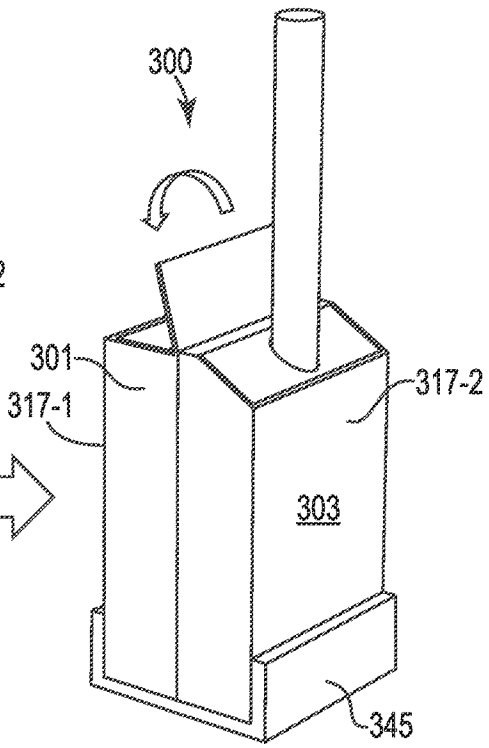
FIGS. 3A, 3B, 3C, and 3D illustrate an example block diagram of a method for transforming a writing device packaging box from an unfolded configuration to a folded configuration, in accordance with the present disclosure.
Figure 3B:
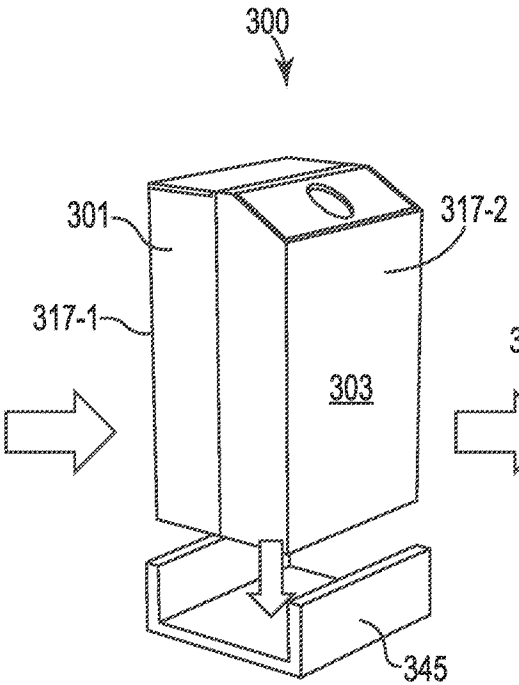
Figure 3A:
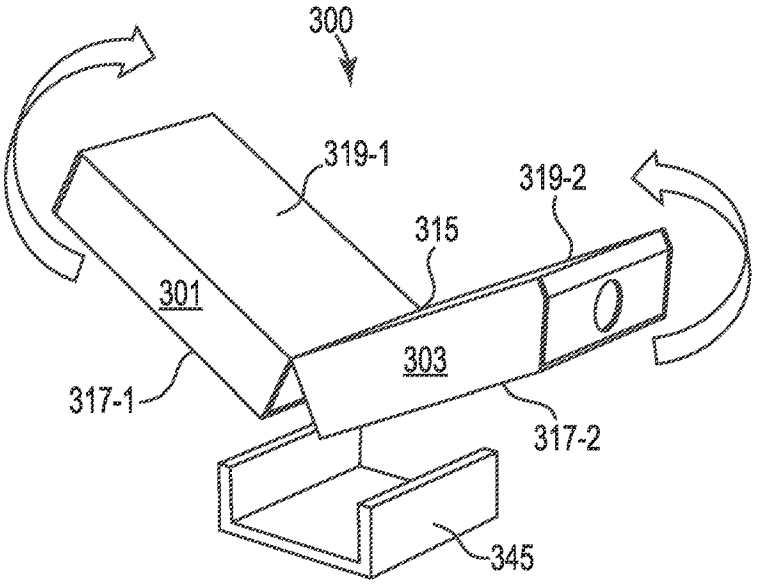

In FIG. 3A, the base holder 345 is removed from the packaging box 300, and first section 301 and second section 303 are folded inward along axis of rotation 315. The first section 301 and the second section 303 are folded inward by applying a force to the respective sides of the packaging box 300. For instance, the packaging box 300 may be folded into the folded configuration by removing the base holder 345 from the packaging box 300, applying a force to the first face wall 317-1 and a force to the second face wall 317-2.

Once the first section 301 and the second section 303 are folded together, as illustrated in FIG. 3B, the two sections may be coupled together. For instance, the first section 301 may be coupled to the second section 303 by an adhesive backing disposed on the first back wall 319-1 and/or the second back wall 319-2. In some examples, the first section 301 may be coupled to the second section 303 by an adhesive backing disposed on the first back wall 319-1 and/or the second back wall 319-2. Examples are not so limited and the first section 301 may be coupled to the second section 303 by any coupling means. The packaging box in the folded configuration as illustrated in FIG. 3B, may then be inserted in the base holder 345.

As illustrated in FIG. 3C, the packaging box 300 in the folded configuration may then operate as an apparatus to store the writing device 335. For instance, the writing device 335 may be inserted into the second aperture 309-2 of the second section 303 for storage. As described herein, the tip of the writing device 335 may be protected from the base holder 345 by protective substrate disposed on a top surface of the base holder 345. In some examples, the tip of the writing device 335 may be protected from the base holder 345 by a removable flap.

Figure 3D:
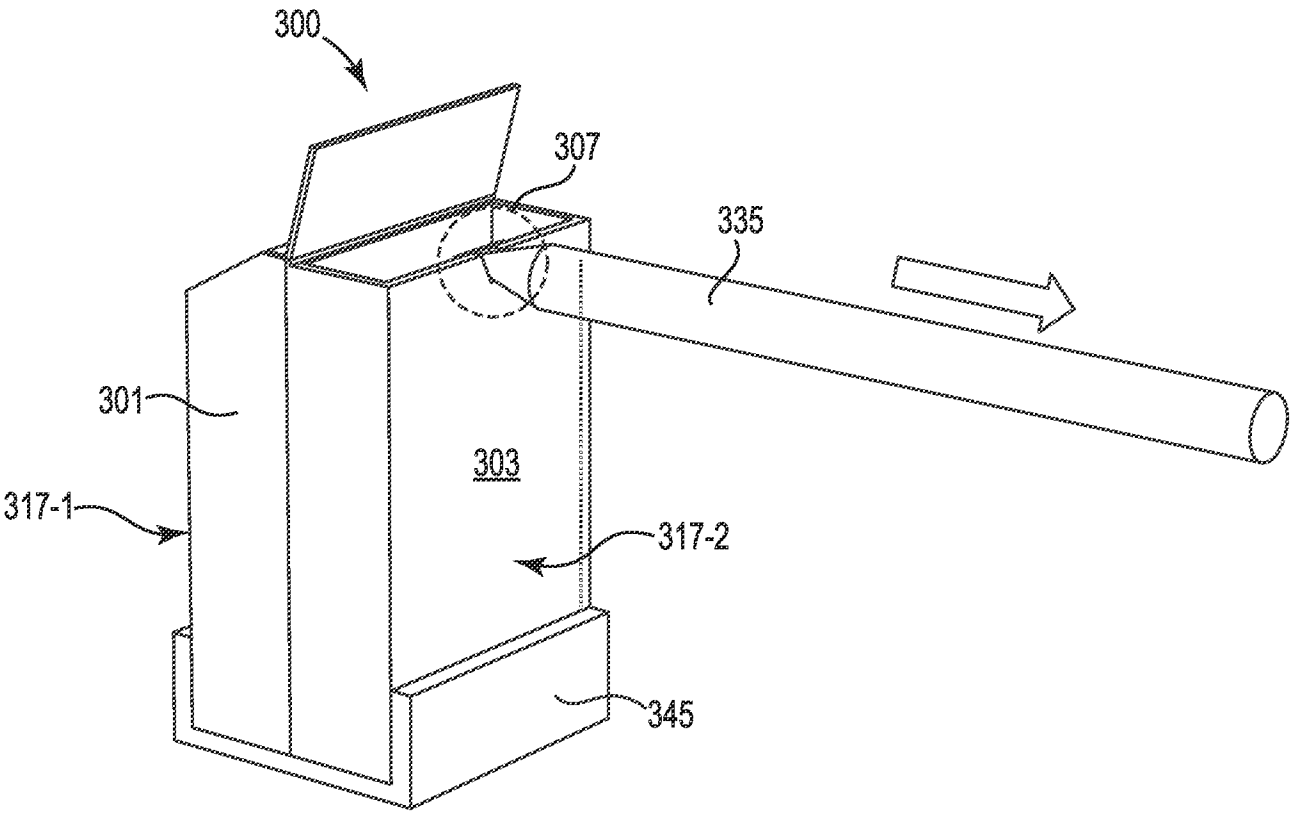

As illustrated in FIG. 3C, the second aperture 309-2 in the second section 303 may receive the writing device 335. As illustrated in FIG. 3D, the first aperture 309-1 in the first section 301 may receive a tip of the writing device 335 for removal of the tip from the writing device 335. For instance, as illustrated, the tip of the writing device 335 may be inserted into the tip remover 307 on the first section 303 (e.g., tip remover 107 illustrated in FIG. 1B). Responsive to application of a force in the direction of the arrow, the tip of the writing device 335 may be removed from a body of the writing device.

Figure 4:
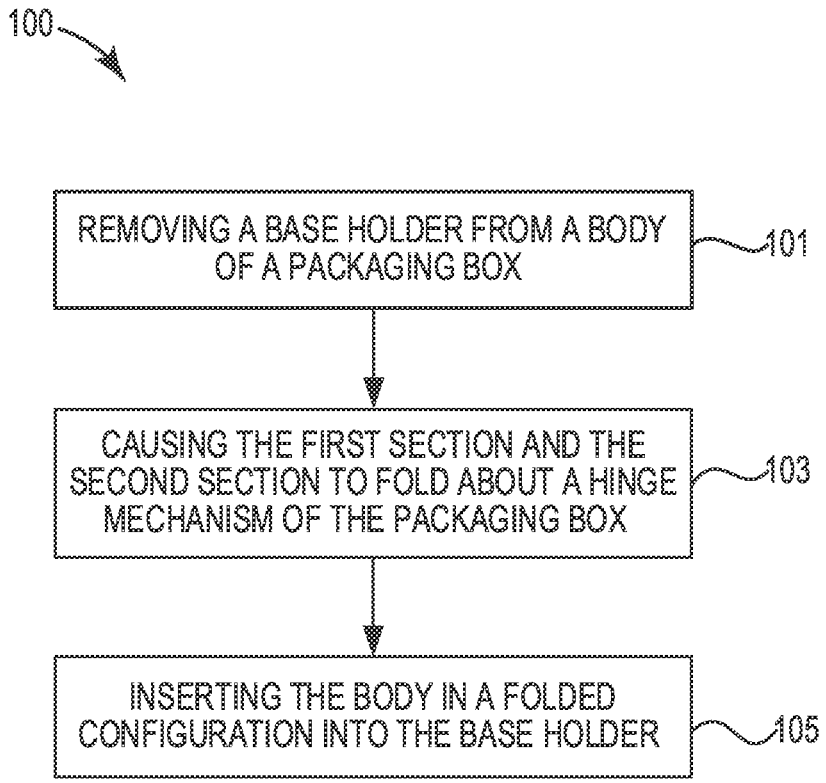
FIG. 4 illustrates a block diagram of an example for converting writing device packaging box from an unfolded configuration to a folded configuration, in accordance with the present disclosure.

FIG. 4 illustrates a block diagram of an example 402 for converting writing device packaging box from an unfolded configuration to a folded configuration, in accordance with the present disclosure. The method described an illustrated with regards to FIG. 4 may be the same as or similar to the method illustrated with regards to FIGS. 3A, 3B, 3C, and 3D.

At 404, the method 402 includes removing a base holder from a body of a packaging box. For instance, as illustrated in FIG. 3A, the method includes removing a base holder from a body of a packaging box, wherein the body defines a cavity that includes a first section and a second section, and wherein the first section includes a first aperture to receive a portion of a writing device and the second section includes a second aperture to receive a remainder of the writing device.

At 406, the method 402 includes causing the first section and the second section to fold about a hinge mechanism of the packaging box. For instance, the method may include applying a force to the first section and to the second section, causing the first section and the second section to fold about a hinge mechanism of the packaging box.

At 408, the method 402 includes inserting the body in a folded configuration into the base holder.

As discussed with regards to FIG. 2A, the first section may include a first storage area that is distal to the hinge mechanism, wherein the first storage area includes a tip remover. In such examples, the method 402 includes removing a tip of the writing device by inserting the tip of the writing device into the tip remover and applying a force to the writing device to remove the tip of the writing device from a remainder of the writing device.

In some examples, the method includes removing the body in the folded configuration from the base holder. For instance, the method may include removing the folded packaging box from the base holder, by moving from FIG. 3C to FIG. 3B. The method may also include applying a force to the first section and to the second section, causing the first section and the second section to unfold about the hinge mechanism, and inserting the base holder in the body in an unfolded configuration. For instance, the method may include unfolding the first section and the second section, by moving from FIG. 3B to FIG. 3A. After unfolding the first section and the second section, the first section and the second section are aligned in series in the unfolded configuration.

In some examples, inserting the body in the folded configuration into the base holder includes coupling a first back wall of the first section and a second back wall of the second section such that the first section and the second section are aligned in parallel in the folded configuration.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A packaging box, comprising:

a first section including a first aperture to receive a portion of a writing device;

a second section including a second aperture to receive a remainder of the writing device;

a hinge mechanism coupling the first section to the second section, wherein the first section and second section are rotatable about the hinge mechanism; and a tip remover including a surface to remove a tip of the writing device responsive to application of a force;

wherein the first aperture of the first section is defined by a first plurality of side walls extending generally parallel to the hinge mechanism, and the second aperture of the second section is defined by a second plurality of side walls extending generally parallel to the hinge mechanism.

2. The packaging box of claim 1, wherein the first section includes an orthogonal wall defining a first storage area distal to the hinge mechanism, and the second section includes an orthogonal wall defining a second storage area distal to the hinge mechanism.

3. The packaging box of claim 1, wherein the first section includes a first face wall and a first back wall, and the second section includes a second face wall and a second back wall, wherein the first back wall and the second back wall comprise a contiguous surface with a lateral perforated line forming the hinge mechanism.

4. The packaging box of claim 3, wherein the tip remover includes an aperture in the first face wall and a reinforcing metal plate coupled to the aperture, wherein the aperture in the face wall and the reinforcing metal plate having a concave surface to receive the tip of the writing device and apply a resistive force in response to removal of the writing device from the aperture.

5. A packaging box, comprising:

a body defining a cavity, wherein the body includes a first section and a second section, wherein the first section includes a first aperture to receive a portion of a writing device, and wherein the second section includes a second aperture to receive a remainder of the writing device;

a hinge mechanism coupling the first section to the second section, wherein the first section and second section are rotatable about the hinge mechanism; and a base holder stored in the cavity, wherein the base holder is to retain the first section and the second section when the body is in a folded configuration;

wherein the base holder comprises a length approximately equal to a width of the first section and a width of the second section and comprises a width greater than a combined thickness of the first section and the second section.

6. The packaging box of claim 5, wherein the first section includes a first face wall and a first back wall, and the second section includes a second face wall and a second back wall, wherein the first back wall and the second back wall include fastening means to couple the first section and the second section.

7. The packaging box of claim 5, including a removable flap coupled to the first section or the second section, the removable flap to hold a tip of the writing device away from the base holder.

8. The packaging box of claim 5, wherein the base holder includes a top surface to receive the first section and the second section when the packaging box is folded at the hinge mechanism, and a bottom surface opposite of the top surface, the top surface including a protective substrate to receive a tip of the writing device.

9. A method, comprising:

removing a base holder from a body of a packaging box, wherein the body defines a cavity that includes a first section and a second section, and wherein the first section includes a first aperture to receive a portion of a writing device and the second section includes a second aperture to receive a remainder of the writing device;

applying a force to the first section and to the second section, causing the first section and the second section to fold about a hinge mechanism of the packaging box; and inserting an outer wall of the body in a folded configuration into the base holder.

10. The method of claim 9, wherein the first section includes a first storage area that is distal to the hinge mechanism, the first storage area including a tip remover, the method including removing a tip of the writing device by inserting the tip of the writing device into the tip remover and applying a force to the writing device to remove the tip of the writing device from a remainder of the writing device.

11. The method of claim 9, including:

removing the body in the folded configuration from the base holder;

applying a force to the first section and to the second section, causing the first section and the second section to unfold about the hinge mechanism; and inserting the base holder in the body in an unfolded configuration, wherein the first section and the second section are aligned in series in the unfolded configuration.

12. The method of claim 9, wherein inserting the body in the folded configuration into the base holder includes coupling a first back wall of the first section and a second back wall of the second section such that the first section and the second section are aligned in parallel in the folded configuration.

* * * * *